United States Patent [19]

Atoji et al.

[11] 4,239,945

[45] Dec. 16, 1980

[54] SEALED HEADPHONE

[75] Inventors: Nobuhisa Atoji, Toyonaka; Shoichi Kusomoto, Matsubara; Kazue Sato, Kodoma, all of Japan

[73] Assignee: Matsushita Electric Industrial Co., Ltd., Osaka, Japan

[21] Appl. No.: 859,815

[22] Filed: Dec. 12, 1977

[30] Foreign Application Priority Data

Dec. 15, 1976 [JP] Japan ..... 51 151103

[51] Int. Cl.[3] ..... H04R 1/10

[52] U.S. Cl. ..... 179/182 R; 179/156 R

[58] Field of Search ..... 179/182 R, 156 R, 180, 179/1 E; 181/137, 129

[56] References Cited

U.S. PATENT DOCUMENTS

| | | | |
|---|---|---|---|
| 1,366,607 | 1/1921 | Steinberger | 179/179 |
| 2,603,724 | 7/1952 | Kettler | 179/182 R |
| 3,220,505 | 11/1965 | Hargrave | 179/182 R X |

FOREIGN PATENT DOCUMENTS

| | | | |
|---|---|---|---|
| 2252189 | 5/1973 | Fed. Rep. of Germany | 179/182 R |
| 1370930 | 7/1964 | France | 179/1 E |
| 109966 | of 1940 | United Kingdom | 181/156 |

OTHER PUBLICATIONS

"Improved Earphone Enclosure for Communication in Noise" by Bauer and DiMattia, Journal of Acoustical Soc. of America, vol. 51, No. 5 (1972), pp. 1388–1393.

"Audiometer-Earphone Mounting to Improve Inter-subject and Cushion-Fit Reliability", by E. Villchur, Journal of the Acoustical Soc. of America, vol. 48, No. 6 (Part 2), Dec. 1970, pp. 1387–1396.

*Primary Examiner*—Thomas W. Brown

*Attorney, Agent, or Firm*—Stevens, Davis, Miller & Mosher

[57] ABSTRACT

A sealed headphone having an improved sound pressure versus frequency response characteristic is disclosed. The sealed headphone comprises a mounting plate having coupling apertures, an electro-acoustic transducer attached to one side of the mounting plate and a casing covering the transducer. A space defined by the rear side of the transducer and the casing communicates via the coupling apertures with another spaced formed on the opposite side of the mounting plate so as to form an acousto-mechanical resonance circuit within the headphone. By raising the parallel resonance frequency of the resonance circuit, a higher reproduced frequency limit of the headphone is achieved.

6 Claims, 9 Drawing Figures

SEALED HEADPHONE

The present invention relates to a sealed headphone having an excellent sound shielding effect to external noise and a higher reproduction frequency without any sacrifice in the sound shielding effect.

Figure 3A:
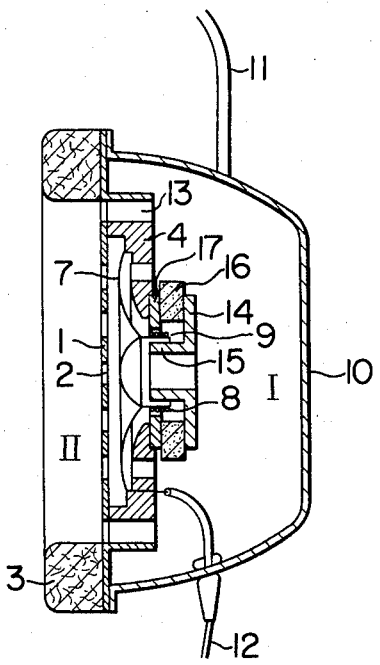
Figure 3B:
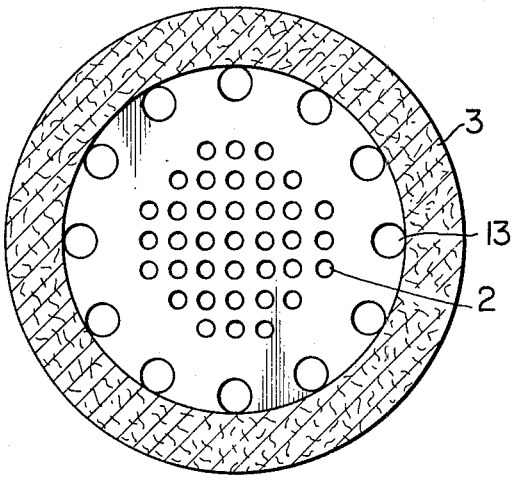
Figure 4:
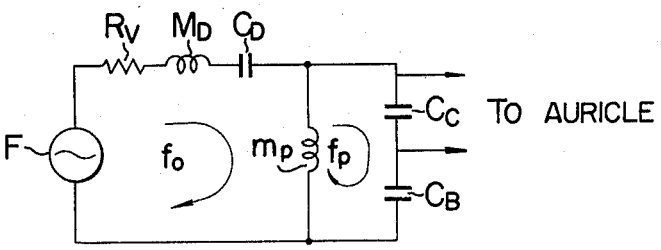
Figure 5A:
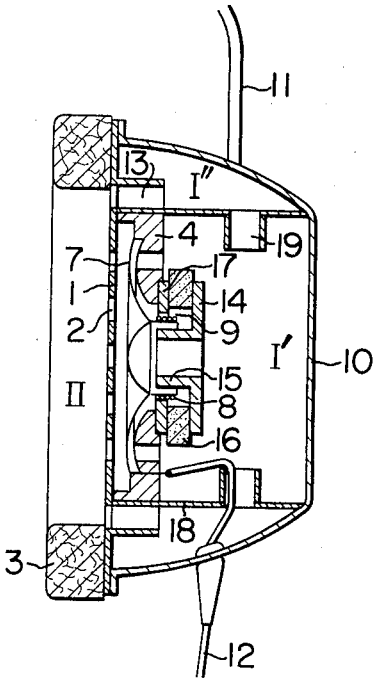
Figure 5B:
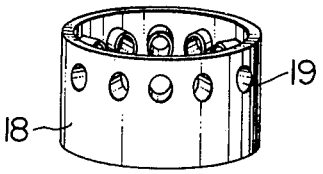
Figure 6:
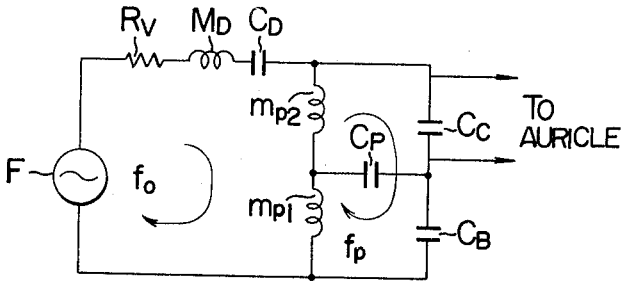
Figure 7:
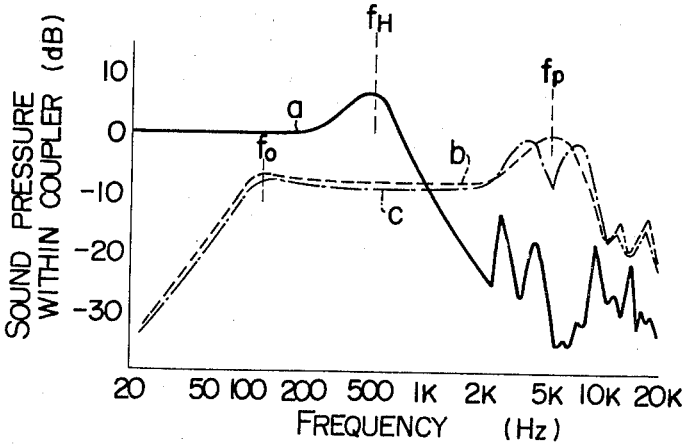

FIGS. 3A and 3B respectively show a sectional and front view of a sealed headphone in accordance with one embodiment of the present invention;

FIG. 4 shows an equivalent circuit of an acoustic mechanical system of the headphone shown in FIG. 3;

FIGS. 5A and 5B respectively show a sectional and partial perspective view of another embodiment of the present invention;

FIG. 6 shows an equivalent circuit of an acoustic mechanical system of the sealed headphone shown in FIG. 5; and FIG. 7 shows sound pressure frequency characteristics of the sealed headphones of the prior art and present invention.

Figure 1:
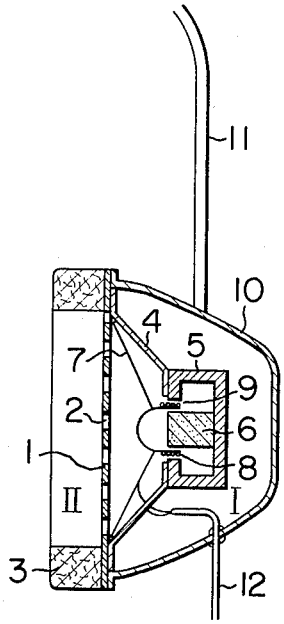
FIG. 1 PRIOR ART
FIG. 1 shows a sectional view of a prior art sealed headphone.
Figure 2:
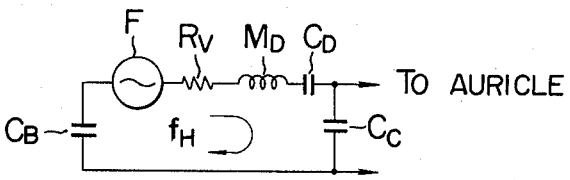
FIG. 2 PRIOR ART
FIG. 2 shows an equivalent circuit of an acoustic mechanical system of the sealed headphone shown in FIG. 1.

Referring to FIGS. 1 and 2, a prior art headphone is explained.

In FIG. 1, numeral 1 denotes a mounting plate having sound apertures 2 formed therethrough. Numeral 3 denotes a shield pad mounted on a front side of the mounting plate 1 and numeral 4 denotes a frame mounted on a rear side of the mounting plate 1. A yoke 5 is fixed at a rear end of the frame 4. Numeral 6 denotes a magnet positioned at the center of the yoke 5 with the yoke 5 and the magnet 6 constituting a magnetic circuit. Numeral 7 denotes a diaphragm on which a voice coil 8 is wound. The voice coil 8 is positioned in a ring-shaped magnetic gap 9 of the magnetic circuit. Numeral 10 denotes a cup-shaped casing fixed to the rear side of the mounting plate 1 covering the magnetic circuit, the diaphragm 7, the voice coil 8 and the frame 4. Numeral 11 denotes an elastic head band and numeral 12 denotes a cord connected to the voice coil 8.

FIG. 2 shows an equivalent circuit of an acoustic-mechanical system of the prior art sealed headphone shown in FIG. 1. In FIG. 2, F represents a motive force produced by electric power, Rv represents an electromagnetic damping resistance by the voice coil 8, $M_D$ represents the mass of a vibration system, $C_D$ represents the compliance of the vibration system, $C_B$ denotes the capacitance of the sealed volume I on the rear side of the diaphragm, and $C_C$ represents the capacitance of a sealed volume II between the diaphragm 7 and an eardrum when the headphone is loaded in position.

As is apparent from the structure of the sealed headphone, there is no aeration aperture to the external environment when the headphone is loaded in place so that external noise is shut out to provide an excellent sound shielding effect. When one monitors a recording condition during a recording operation, it is necessary that he monitor only the sound being recorded and sealed headphones having an excellent sould shielding characteristic is typically used for the purpose. However, as seen from the equivalent circuit of the acoustic-mechanical system shown in FIG. 2, an upper limit frequency of a reproduced sound is roughly given by;

$$f_H = \frac{1}{2\pi\sqrt{M_D\left(\frac{1}{\frac{1}{C_B}+\frac{1}{C_D}+\frac{1}{C_C}}\right)}} \text{ (Hz)} \quad (1)$$

That is, a serial resonance frequency of the mass $M_D$ of the diaphragm, the compliance $C_D$ of the diaphragm and the capacitance $C_C$ and $C_B$ of the front and rear volumes of the diaphragm determine the upper limit of the playback sound. In order to raise the upper limit frequency $f_H$, it is necessary to reduce $M_D$, $C_D$, $C_C$ and $C_B$, however, the mass $M_D$ of the diaphragm cannot be reduced too much because a certain magnitude of mass is required to form the diaphragm. Further, a certain amount of compliance is required for each of the other compliances in order to prevent the deterioration of low frequency characteristic when there exists leakage between the ear-pad and an ear. Because of those factors, the upper limit frequency $f_H$ for reproduced sound has heretofore been limited to below 1 KHz.

The present invention is intended to enable reproduction to higher frequencies in a sealed headphone while retaining an excellent sound shielding effect.

Referring now to FIGS. 3A, 3B and 4, one embodiment of the present invention is explained. In FIGS. 3A, 3B and 4, like reference numerals and symbols show like parts to those shown in FIGS. 1 and 2.

A feature of the present embodiment resides in that a coupling aperture 13 formed in the mounting plate 1 serves to communicate the volume II on the front side of the diaphragm to the volume I within the casing 10. In FIG. 3A, numeral 14 denotes a lower plate having a center pole 15 integrally formed, numeral 16 denotes a ring magnet and numeral 17 denotes an upper ring plate. The parts 14 to 17 constitutes a magnetic circuit.

The coupling aperture 13 may be tubular as shown in FIGS. 3A, 3B or it may be a ring tube, or where the mouting plate 1 is thick an aperture may be formed through the mounting plate 1. Alternatively, a diaphragm may be provided over the coupling aperture through which two spaces are coupled.

FIG. 4 shows an equivalent circuit of an acoustic-mechanical system of the embodiment shown in FIGS. 3A, 3B. As seen from FIG. 4, an acoustic mass reactance $m_p$ provided by the coupling aperture 13 has been added to the prior art equivalent circuit.

In the sealed headphone in accordance with the preferred embodiment of the present invention shown in FIGS. 3A, 3B, an upper limit frequency thereof is roughly determined by a resonance frequency $f_p$ of a parallel resonance circuit comprising $m_p$, $C_C$ and $C_B$ of the acoustic-mechanical system equivalent circuit shown in FIG. 4;

$$f_p = \frac{1}{2\pi\sqrt{m_p\left(\frac{1}{\frac{1}{C_C}+\frac{1}{C_B}}\right)}} \quad (2)$$

Thus, in order to reproduce higher frequencies, the mass reactance $m_p$ of the coupling aperture 13 may be reduced or the compliances $C_C$ and $C_B$ reproduced by the front and rear volumes may be reduced. The $C_C$ and $C_B$ cannot be reduced too much, as in the prior art sealed headphone, because of possible deterioration in the low frequency response caused by leakage from the space between the ear-pad and the ear. However, the acoustic mass reactance $m_p$ can be equivalently made smaller than the mass of the diaphragm because it does not appreciably influence the other characteristics. As a result, a higher frequency can be reproduced. In the present embodiment, the mass reactance $m_p$ is chosen such that $f_p$ is approximately 5 KHz.

FIGS. 5A, 5B show another embodiment of the present invention. A difference between the present embodiment and the embodiment shown in FIGS. 3A, 3B resides in that a tubular partitioning element 18 (FIG. 5B) is mounted on the rear side of the mounting plate 1 to divide the sealed volume I on the rear side of the mounting plate 1 into two parts I' and II', which are then coupled through a coupling aperture 19.

FIG. 6 shows an equivalent circuit of an acoustic-mechanical system of the FIGS. 5A, 5B embodiment. In FIG. 6, $m_{p1}$ represents an acoustic mass reactance presented by the coupling aperture 19, $C_p$ represents a capacitance presented by the sub-volume I'' and $m_{p2}$ represents an acoustic mass reactance presented by the coupling aperture 13. The elements forming $m_{p1}$, $m_{p2}$ $C_p$, $C_c$ and $C_B$ constitute a resonance circuit of the acoustic mechanical system, by which the upper limit of the reproduction frequency is raised.

FIG. 7 shows sound pressure characteristics within small volume couplers of the sealed headphones shown in FIGS. 1, 3A, 3B and 5. In FIG. 7, a curve a shows a characteristic of the prior art sealed headphone. Since the prior art sealed headphone uses a compliance control region, it can exhibit a flat playback characteristic in a low frequency range, but it exhibits a peak between 500 Hz and 1 KHz and it is difficult to reproduce higher frequencies. A curve b shown in FIG. 7 represents a characteristic of the sealed headphone of the present invention shown in FIG. 3. Since it does not use the compliance control, it cannot reproduce the ultra low frequency range but it can exhibit a flat playback characteristic in a high frequency range. Thus, the sealed headphone of the present invention has an excellent sound shielding characteristic like the prior art sealed headphone and yet it has a flat playback sound pressure characteristic in the high frequency range like an open headphone which is of velocity type. The sealed headphone of the present invention can reproduce a clear sound with high fidelity without being disturbed by external noise. A curve c shown in FIG. 7 represents a characteristic of the sealed headphone of the present invention shown in FIG. 5. The headphone characteristic is of dual-peak characteristic having two peaks between 2 KHz and 6 KHz. The dual-peak characteristic is produced in listening sound radiated from a speaker, by the influence of a sound pressure-frequency characteristic of diffractions of the lisner's head and ear canal. The sealed headphone of the present invention shown in FIGS. 5A, 5B can exhibit the dual-peak characteristic like in the case of listening by the speaker, in spite of the sealed headphone. Thus, it can reproduce the sound with high fidelity.

As described hereinabove, in the sealed headphone of the present invention, the coupling aperture is formed in the mounting plate or a coupling aperture having a diaphragm is provided to couple the space on the front side of the mounting plate to the space within the casing on the rear side of the mounting plate through the coupling aperture. The present invention enables the reproduction of higher frequencies without sacrificing the sound shielding effect of the sealed headphone.

What is claimed is:

1. A sealed headphone comprising:

a pad attached to a front side of a mounting plate having sound apertures formed therethrough, an electro-acoustic transducer having a vibrating element for emitting sounds from the front and rear surface of said element attached to a rear side of said mounting plate, a sound sealed casing covering the rear side of said electro-acoustic transducer to provide an enclosed rear space within said casing which receives sounds emitted from the rear surface of said element, first coupling apertures provided in said mounting plate for coupling the rear space within said casing with a front listening space in front of said mounting plate, said sound apertures channeling sound generated from a front surface of said vibrating element of said electro-acoustic transducer forwardly into said front listening space, and said first coupling apertures channeling sound generated from a rear surface of said vibrating element within said casing into said front listening space, and an acoustic-mechanical resonance circuit for improving the high frequency response of said headphone consisting of a volume compliance of said front space, a different volume compliance of said rear space and an acoustic mass reactance of said coupling apertures.

2. A sealed headphone according to claim 1 wherein said acoustic-mechanical resonance circuit has a resonance frequency near 5 KHz.

3. A sealed headphone according to claim 1 wherein a diaphragm is applied over said first coupling apertures.

4. A sealed headphone according to claim 1 wherein the rear space within the casing is divided into two parts by a partitioning element and the divided parts are coupled by second coupling apertures formed through said partitioning element.

5. A sealed headphone according to claim 4 wherein said partitioning element and first and second coupling apertures are configured to provide said headphone with a dual-peak frequency characteristic having two peaks between 2 KHz and 6 KHz.

6. A sealed headphone comprising:

a mounting plate having sound apertures and coupling apertures formed therein, a pad attached to a front side of said mounting plate, an electro-acoustic transducer attached to a rear side of said mounting plate and having a vibrating element at a front side thereof emitting sounds through said sound apertures and sound passing holes communicating with the rear side of said vibrating element provided at a rear side thereof, a sound sealed casing attached to the rear side of said mounting plate to enclose said transducer and receive sounds passing through said sound passing holes thereby forming a rear space defined by the rear side of said transducer and said casing, said rear space communicating with a listening space at the front side of said mounting plate through said coupling apertures, and an acoustic-mechanical resonance circuit for improving the high frequency response of said headphone consisting of a volume compliance of said rear space, a volume compliance of said listening space provided in front of said mounting plate and an acoustic mass reactance of said coupling apertures, said resonance circuit having a parallel resonance frequency defining the high limit of reproduced frequencies.

* * * * *